US007337479B2

(12) United States Patent
Van Huystee

(10) Patent No.: US 7,337,479 B2
(45) Date of Patent: Mar. 4, 2008

(54) INFANT PLAYARD WITH A RECONFIGURABLE ENTERTAINMENT DEVICE

(75) Inventor: Maarten Van Huystee, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 176 days.

(21) Appl. No.: 11/074,005

(22) Filed: Mar. 8, 2005

(65) Prior Publication Data

US 2005/0198733 A1 Sep. 15, 2005

Related U.S. Application Data

(60) Provisional application No. 60/551,049, filed on Mar. 9, 2004.

(51) Int. Cl.
*A47D 15/00* (2006.01)

(52) U.S. Cl. ..... 5/93.1; 5/503.1; 5/658; 446/227

(58) Field of Classification Search ..... 5/93.1, 5/93.2, 904, 905, 907, 503.1, 658; 446/227
See application file for complete search history.

(56) References Cited

U.S. PATENT DOCUMENTS

| | | | | |
|---|---|---|---|---|
| 4,188,745 | A | 2/1980 | Harvey | |
| 4,223,471 | A | 9/1980 | Greenberg | |
| 4,640,034 | A * | 2/1987 | Zisholtz | 40/455 |
| 4,811,437 | A | 3/1989 | Dillner | |
| 4,973,286 | A | 11/1990 | Davison | |
| 5,370,570 | A | 12/1994 | Harris | |
| 5,672,088 | A | 9/1997 | Chininis | |
| D400,619 | S | 11/1998 | Schultheis | |
| 6,099,377 | A | 8/2000 | Pridemore | |
| 6,170,101 | B1 | 1/2001 | McCloud | |
| 6,301,731 | B1 | 10/2001 | Jakubowski | |
| 6,438,772 | B1 | 8/2002 | Brown | |
| 6,475,057 | B1 | 11/2002 | Norman | |
| 6,482,066 | B1 | 11/2002 | Kelly | |
| 6,574,812 | B2 | 6/2003 | Jakubowski | |
| 6,658,678 | B2 | 12/2003 | Hotaling | |
| 2002/0094748 | A1 | 7/2002 | Baik | |
| 2002/0104161 | A1 | 8/2002 | Kuo | |
| 2003/0153240 | A1 | 8/2003 | DeJule | |
| 2004/0063381 | A1 | 4/2004 | Norman | |

FOREIGN PATENT DOCUMENTS

EP 0930 035 A1 7/1999

OTHER PUBLICATIONS

Evenflo BabyGo™ Portable Playard with Bassinet, Changer and Mobile, http://www.evenflo.com/pr/py/prpy_bemo.phtml, Mar. 2, 2005.

Kolcraft Travelin'Tot® 4-in-1 with Activity Gym, http://www.kolcraft.com/products/around2.cfm?id=105&p=play, Mar. 2, 2005.

Baby Trend Nursery Care Center & Playard LX 1, http://www.epinions.com/content_76668440196?sp=irev, Mar. 2, 2005.

* cited by examiner

*Primary Examiner*—Michael Trettel
(74) *Attorney, Agent, or Firm*—Edell, Shapiro & Finnan LLC

(57) ABSTRACT

A foldable infant playard with a reconfigurable entertainment device capable of attachment at two separate points. The first position is suspended from a support arm originated from an upper corner of the infant playard. The entertainment device can also be mounted in a second position on a side wall of the infant playard. The side walls of the foldable infant playard of the present invention are formed from an improved printed mesh material.

28 Claims, 13 Drawing Sheets

INFANT PLAYARD WITH A RECONFIGURABLE ENTERTAINMENT DEVICE

CROSS-REFERENCE TO RELATED APPLICATIONS

This application claims priority from U.S. Provisional Patent Application Ser. No. 60/551,049, entitled "Playard With a Reconfigurable Entertainment Device" and filed Mar. 9, 2004. The disclosure of the above-mentioned provisional application is incorporated herein by reference in its entirety.

FIELD OF THE INVENTION

The present invention relates to a foldable infant playard with a reconfigurable entertainment device. The reconfigurable entertainment device is capable of attachment to the foldable infant playard at two or more separate locations. At one location, the entertainment device is suspended from a support arm attached proximate an upper corner of the infant playard. The entertainment device can also be mounted on a fabric side wall of the infant playard. The side walls of the foldable infant playard of the present invention are formed from a printed mesh material. For maximum convenience, the foldable playard of the present invention is readily collapsible to a storage position without the removal of any parts. In the storage position, the playard of the present invention is easily transportable from one location to another.

BACKGROUND

Known prior infant playards include upper and lower frame assemblies. The lower frame assembly may include a unitary central hub member, corner leg connecting members that include support feet, and hub legs connecting the hub member to the corner leg connecting members such that the hub legs are collapsible from a substantially horizontal, coplanar, spread configuration wherein the hub legs diverge radially outwardly from the hub member, to a compact, non-coplanar configuration wherein the hub legs are substantially parallel. The upper frame assembly may include corner rail connecting members and side rails, where each of the side rails includes a pair of intermediate rails and a medial rail connecting member disposed therebetween. Each of the intermediate rails is coupled at one end to one of the corner rail connecting members and coupled at an opposite end to the medial rail connecting member such that the pair of intermediate rails is collapsible from a substantially in-line configuration to a generally V-shaped configuration. Corner legs may be coupled at one (lower) end to one of the corner leg connecting members (including a support foot) and at an opposite (upper) end to one of the corner rail connecting members such that the corner legs are collapsible radially inwardly towards the hub member from a substantially parallel configuration wherein the corner legs are spread apart by the hub legs and side rails to a substantially parallel compact configuration wherein the corner legs are drawn together by the hub legs and side rails. An example of such a similar foldable playard is disclosed in U.S. Pat. No. 4,811,437, the disclosure of which is incorporated by reference herein in its entirety.

Known prior infant playards include an infant entertainment device mounted to the upper frame of the playard, e.g., the Baby Trend Tahoe Nursery Care Center & Playard LX1 (Model no. 8188sfw). The removable bassinet of the Baby Trend product includes a canopy featuring hanging toys to entertain the infant received therein. The bassinet is selectively removed from the upper frame to permit access to the entire volume of the playard. In another example, the Evenflo BabyGo Portable Playard with Bassinet, Changer, and Mobile includes a mobile removably mounted to one of the corner rail connecting members of the upper frame. The Kolcraft Travelin' Tot 4-in-1 with Activity Gym is an infant playard with a removable bassinet. The removable bassinet of the Travelin' Tot 4-in-1 product includes two overhead toy bars that connect in the vicinity of the four corners making up the upper frame of the playard. The toy bars have connecting points for attachment of removable hanging toys and a mirror. The bassinet may be removed from the playard and used as a floor gym as the infant grows.

In the prior infant playards, there is a need for an infant entertainment device that may be reconfigurably mounted in multiple positions within the playard for enhanced sensory stimulation for the infant received in the playard.

SUMMARY OF THE INVENTION

Generally, the embodiments of the present invention provide a foldable infant playard with a reconfigurable entertainment device and, more particularly, an infant playard with an entertainment device that may be mounted in multiple positions within the playard for enhanced sensory stimulation of the infant received therein.

BRIEF DESCRIPTION OF THE DRAWINGS

Like reference numerals have been used to identify like elements throughout this disclosure.

DETAILED DESCRIPTION OF THE INVENTION

In accordance with the present invention, a foldable infant playard includes a reconfigurable entertainment device and, more particularly, an entertainment device that may be reconfigurably mounted in multiple positions within the playard for enhanced sensory stimulation of an infant received therein. In one embodiment, the entertainment device is removably mounted on a curved support arm which is connected to one of the corner rail connecting members on the upper frame of the infant playard. In another embodiment, the entertainment device is removably mounted on one of the side walls of the infant playard.

Figure 1:
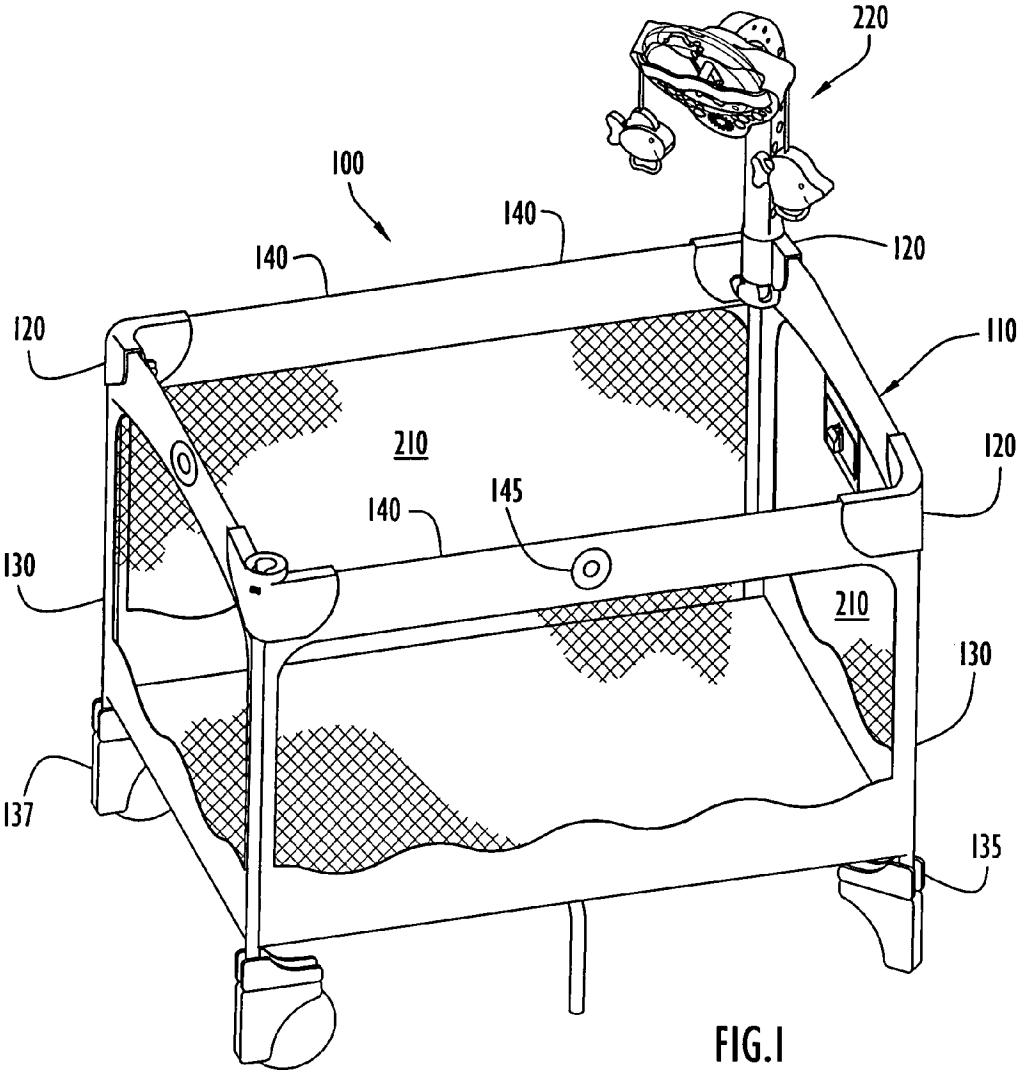
FIG. 1 illustrates a perspective view of the playard according to the present invention, shown in an open position.

As shown in FIG. 1, in the illustrated embodiment, playard 100 includes an upper frame 110. The upper frame 110 includes corner rail connecting members 120 and side rails, where each of the side rails includes a pair of intermediate rails 140 and a medial rail connecting member 145 disposed therebetween. Each of the intermediate rails 140 is coupled at one end to one of the corner rail connecting members 120 and coupled at an opposite end to the medial rail connecting member 145 such that the pair of intermediate rails is collapsible from a substantially in-line configuration (shown) to a generally V-shaped configuration (also called "the storage position"—not shown). Corner legs 130 extend downward from each corner rail connecting members 120. The corner legs 130 are coupled at one (lower) end to a corner leg connecting member 135 and include a support foot 137, and at an opposite (upper) end to one of the corner rail connecting members 120 such that the corner legs 130 are collapsible radially inward towards a hub member (located proximate the center of the playard 100—not shown) from a substantially parallel configuration (as shown) wherein the corner legs 130 are spread apart by the hub legs and side rails to a substantially parallel, compact configuration (the storage position) wherein the corner legs 130 are drawn together by the hub legs and side rails.

The playard 100 of the present invention includes sidewalls formed from a breathable, semi-transparent mesh material 210. The infant entertainment device 220 of the present invention may be reconfigurably mounted in multiple positions within the playard 100 for enhanced sensory stimulation for the infant received therein.

Figure 2:
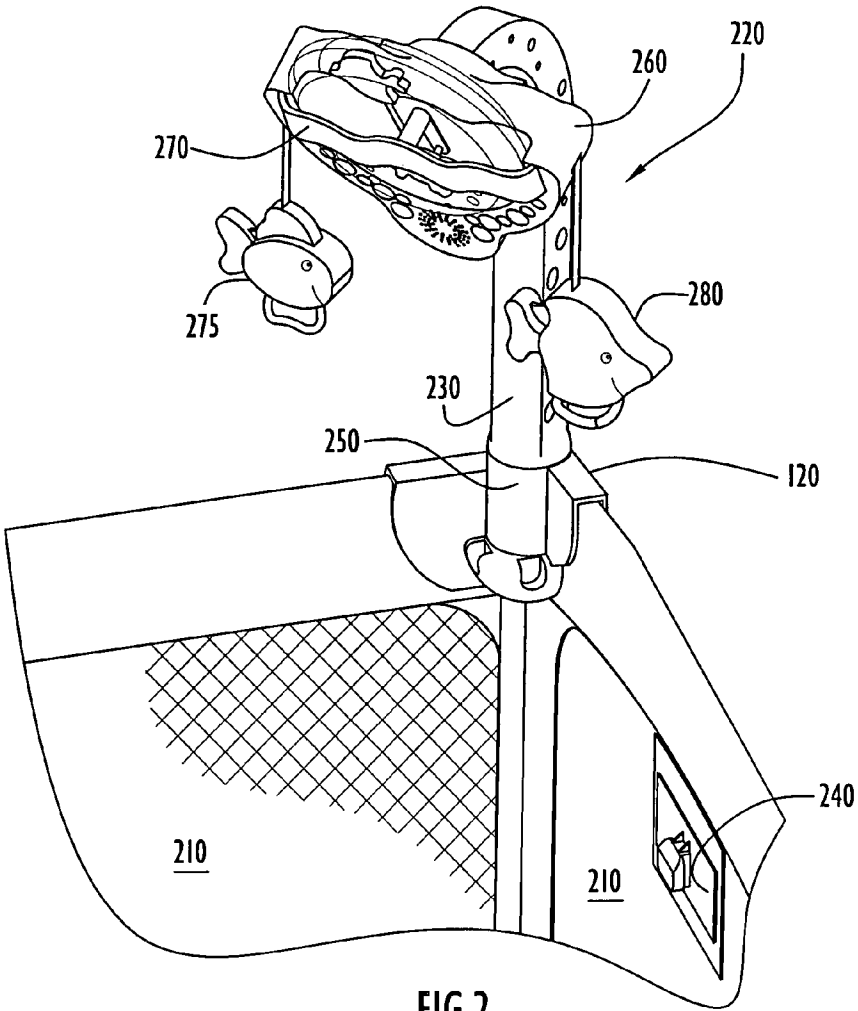
FIG. 2 illustrates an enlarged perspective view of the infant playard of FIG. 1, showing an entertainment device mounted on a support arm and attached proximate an upper corner of the infant playard according to an embodiment of the present invention.

FIG. 2 illustrates an enlarged perspective view of the infant playard 100 with an entertainment device 220 mounted on a curved support arm 230 attached proximate an upper corner of the infant playard 100 according to an embodiment of the present invention. More specifically, the support arm 230 is attached to a mounting plate 250 (which is integrally formed on the inner surface of one or more of the corner rail connecting members 120).

In addition to being adapted for repositioning among the mounting plates 250, the entertainment device 220 may be removed from the curved support arm 230 and coupled to a side wall connecting member 240 (the side wall connecting member 240 is visible on the mesh material 210 of the sidewall of the playard 100). Consequently, entertainment device 220 may also be selectively mounted to side wall connecting member 240.

The infant entertainment device 220 includes a housing 260, a front display/indicia bearing portion 270, and hanging toys 275 and 280. The infant entertainment device 220 of the present invention may further include lights, visual features (water and floating objects, for example), sound/music output, and/or vibration as included in conventional infant entertainment devices. The hanging toys 275 and 280 may include movement or pull sensors which activate the lights, sound/music output, and/or vibration features of the infant entertainment device 220 (as such elements are known to be included in conventional infant entertainment devices (such as infant gyms)). The housing 260 of the infant entertainment device 220 includes a mating portion on its rear surface to allow the removable attachment to the connecting member (discussed in greater detail below) on the curved support arm 230 or the side wall connecting member 240.

Figure 3:
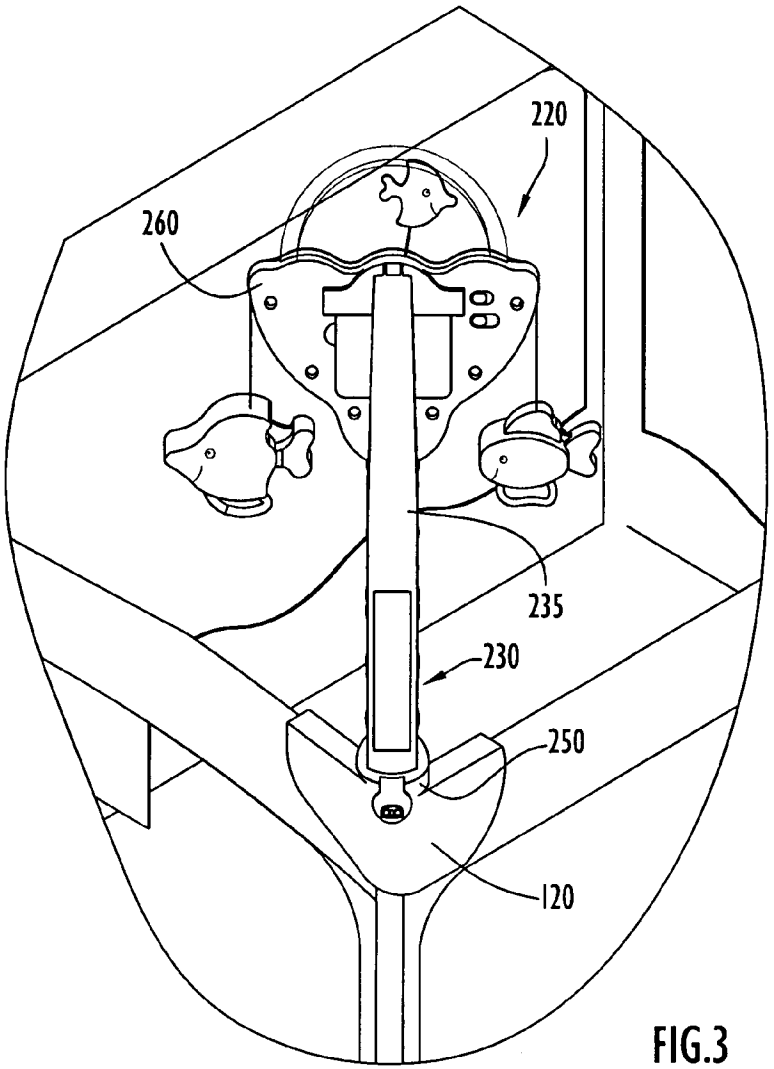
FIG. 3 illustrates a rear, enlarged, perspective view of the entertainment device mounted on a support arm as depicted in FIG. 2.
Figure 4:
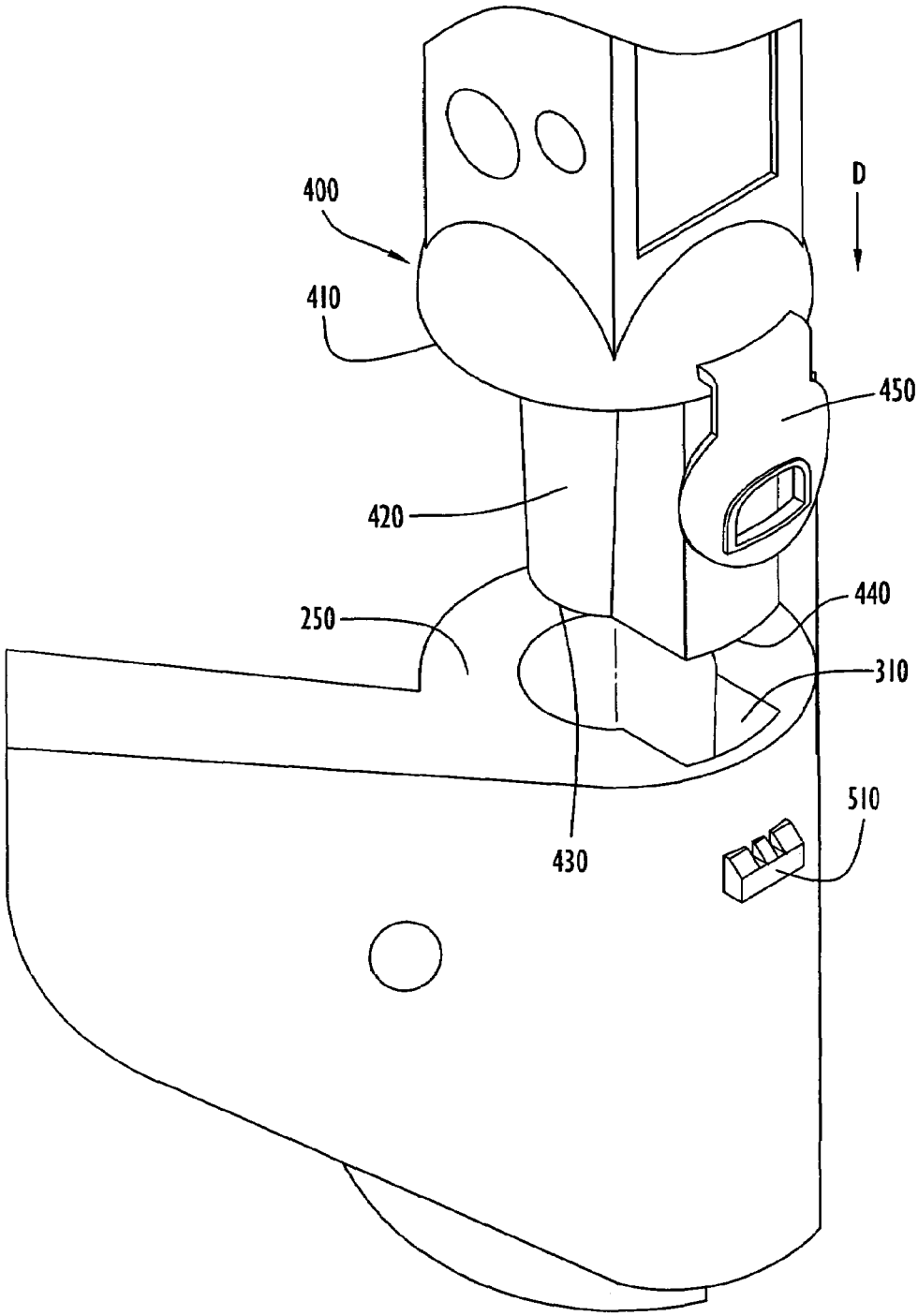
FIG. 4 illustrates a close-up view of the base of the support arm of the entertainment device according to an embodiment of the present invention.
Figure 5:
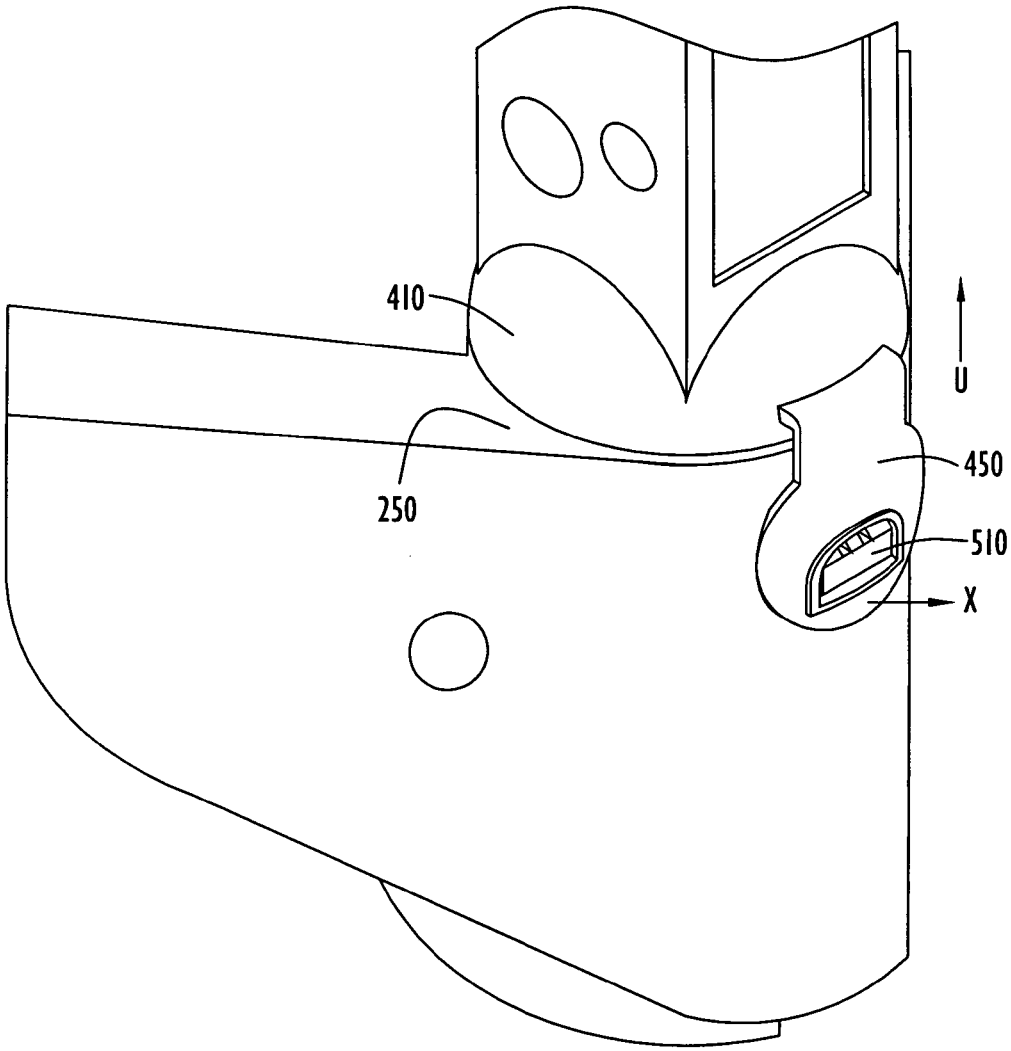
FIG. 5 illustrates a close-up view of the base of the support arm of the entertainment device connected to the mounting plate in an upper corner of the infant playard according to an embodiment of the present invention.

FIGS. 3-5 illustrate the connection of the entertainment device 220 to the curved support arm 230 and, more specifically, the connection of the curved support arm 230 to the mounting plate 250. As referenced above, mounting plates 250 are integrally formed on the inner surface of several of the corner rail connecting members 120. In an alternative embodiment, the mounting plates 250 may comprise separate elements coupled to corner rail connecting members 120. This would allow attachment of the entertainment device 220, curved support arm 230, and mounting plates 250 to any conventional playard arrangement.

FIG. 3 illustrates a rear, enlarged, perspective view of entertainment device 220 mounted on curved support arm 230. Curved support arm 230 is ergonomically formed with rounded edges 235. The top portion of curved support arm 230 includes a connecting member that is similar in shape to the side wall connecting member 240 (described in more detail herein) for removably receiving the entertainment device 220. As discussed above, the curved support arm 230 is removably attachable to mounting plates 250.

FIG. 4 illustrates a close-up view of the base of the curved support arm 230. Curved support arm 230 includes a base portion 400 having an annular lip 410 that flares outward. Extending from base portion 400 in the longitudinal direction (i.e., perpendicular from lip 410) is an extension or neck portion 420. The cross-sectional geometry of neck portion 420 has a generally circular perimeter 430 with slightly smaller rectangular extension 440 (extending radially from neck portion 420).

As best seen in FIG. 4, a locking tab 450 extends from the outer periphery of annular lip 410 in the longitudinal direction. Locking tab 450 is resiliently biased inward to interact with a detent 510 on mounting plate 250 and secure curved support arm 230 within mounting plate 250. Specifically, the locking tab 450 includes a window portion configured to receive the detent 510. Mounting plate 250 includes a recess 310 oriented in a generally vertical direction (with respect to the supporting surface). Recess 310 has an inner profile that accommodates the geometry of neck portion 420 on curved support arm 230. Neck portion 420 is aligned such that when inserted downward along direction D into recess 310, the curved support arm 230 is positioned above and over the interior of playard 100.

FIG. 5 illustrates locking tab 450 in connection with detent 510 when neck portion 420 is received within recess 310. This locking tab and detent feature prevents curved support arm 230 from dislodging unintentionally from recess 310 within mounting plate 250. In order to remove curved support arm 230 from recess 310 within mounting plate 250, force is applied along direction X to the bottom edge of locking tab 450. Once locking tab 450 has cleared detent 510 (e.g., by bending locking tab 450 radially outward), curved support arm 230 may be removed (by pulling the curved support arm 230 upward in direction U) from the recess 310 within mounting plate 250. FIG. 5 also illustrates annular lip 410 in a supported position on a top surface of mounting plate 250.

Figure 6:
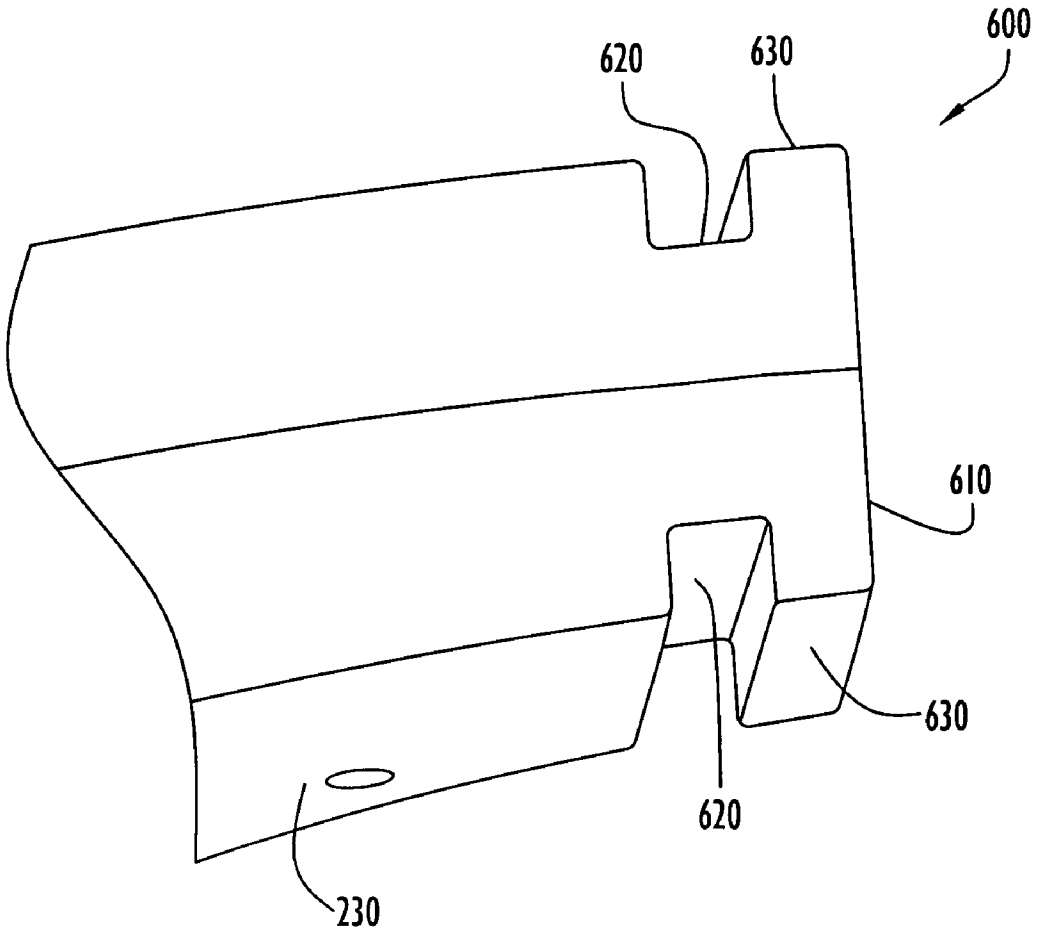
FIG. 6 illustrates a close-up view of one of the connecting members on an end of the support arm of the present invention.

FIGS. 6-9 illustrate connection between entertainment device 220 and curved support arm 230. FIG. 6 illustrates a close-up view of the upper end (opposite the end that includes base portion 400) of the curved support arm 230. Entertainment device 220 slidably engages connecting member 600 (shown in FIG. 6). Connecting member 600 includes a terminal face 610 and a pair of lateral slots 620. The lateral slots 620 run generally parallel to terminal face 610 and create a pair of parallel tongue portions 630 located between lateral slots 620 and terminal face 610.

Figure 7:
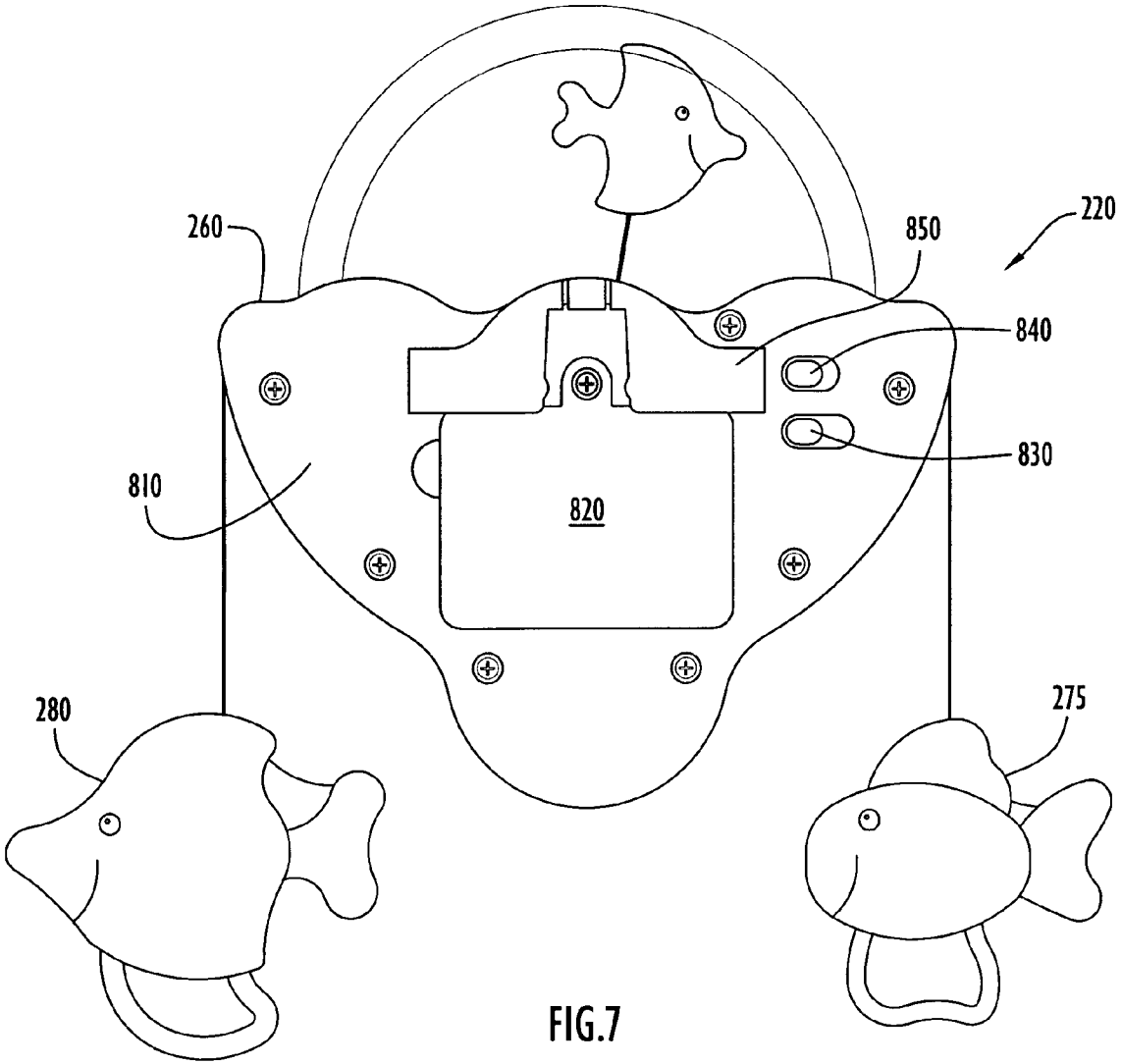
FIG. 7 illustrates a close-up view of the rear of the infant entertainment device in accordance with an embodiment of the present invention.

FIG. 7 illustrates a close-up view of the rear of entertainment device 220. Housing 260 of entertainment device 220 includes a rear face 810. Rear face 810 includes an access cover 820 for a battery compartment to power entertainment device 220. Rear face 810 also includes a power switch 830 and a volume switch 840. Power switch 830 may also permit selection of several available modes of operation (e.g., a learning mode, a musical mode, or a combination thereof). Additionally, rear face 810 includes an attachment portion 850 which projects perpendicularly from rear face 810.

Figure 8:
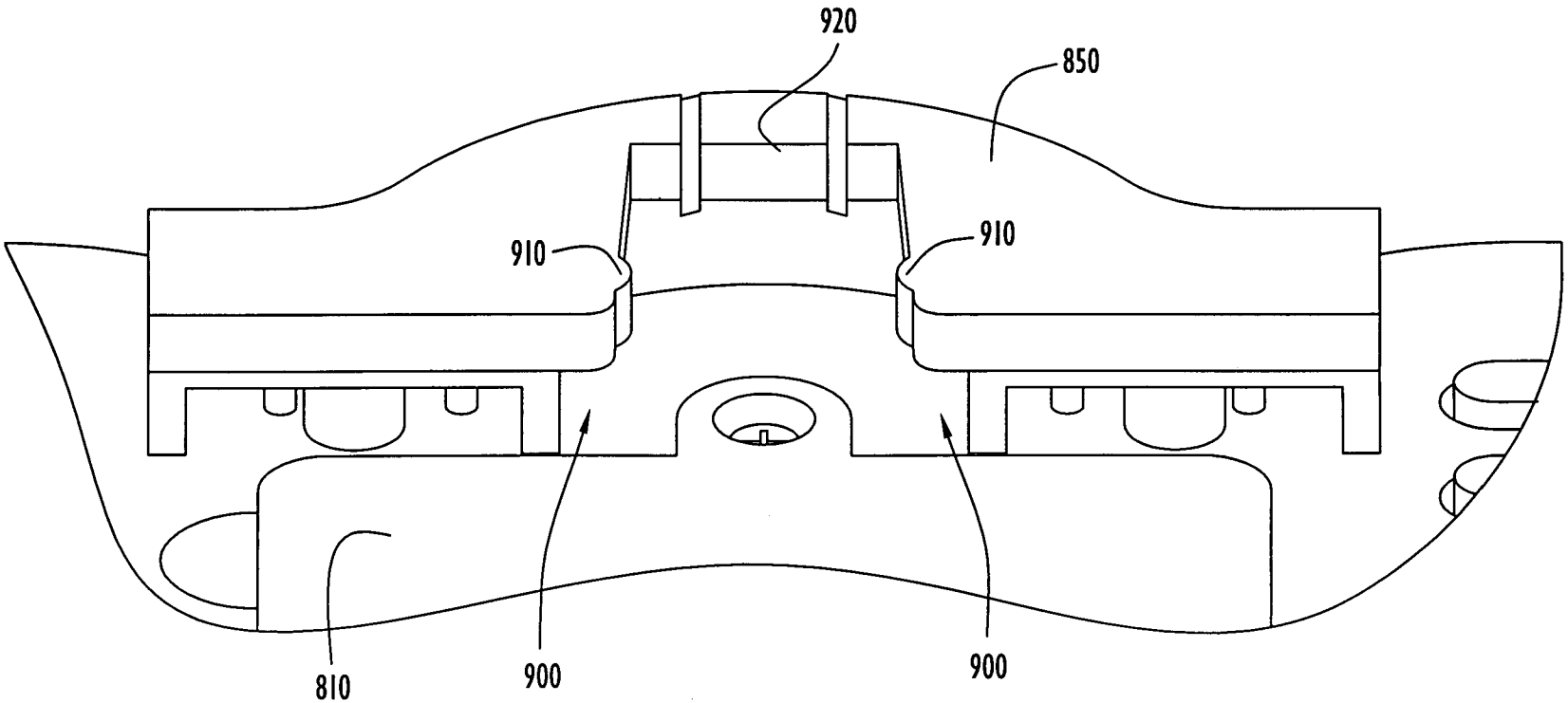
FIG. 8 illustrates an enlarged close-up view of rear of the housing of the entertainment device in accordance with an embodiment of the present invention.

FIG. 8 illustrates an enlarged close-up view of attachment portion 850 on the rear face 810 of entertainment device 220. Attachment portion 850 further includes a pair of channels 900 and extensions 910. Extensions 910 extend perpendicularly with respect to channels 900. As shown in FIG. 8, channels 900 are terminated at a closed end by end wall 920.

When mounting entertainment device 220 to curved support arm 230, extensions 910 of attachment portion 850 are aligned with lateral slots 620 on the connecting member 600 of curved support arm 230. Entertainment device 220 is then slid into place on the end of curved support arm 230. The tolerances between lateral slots 620 and extensions 910 provide sufficient frictional force to prevent entertainment device 220 from disengaging from curved support arm 230 without the application of sufficient additional force to overcome the frictional engagement. Thus, it would be extremely difficult for a young child to dislodge the entertainment device 220 from curved support arm 230.

Figure 9:
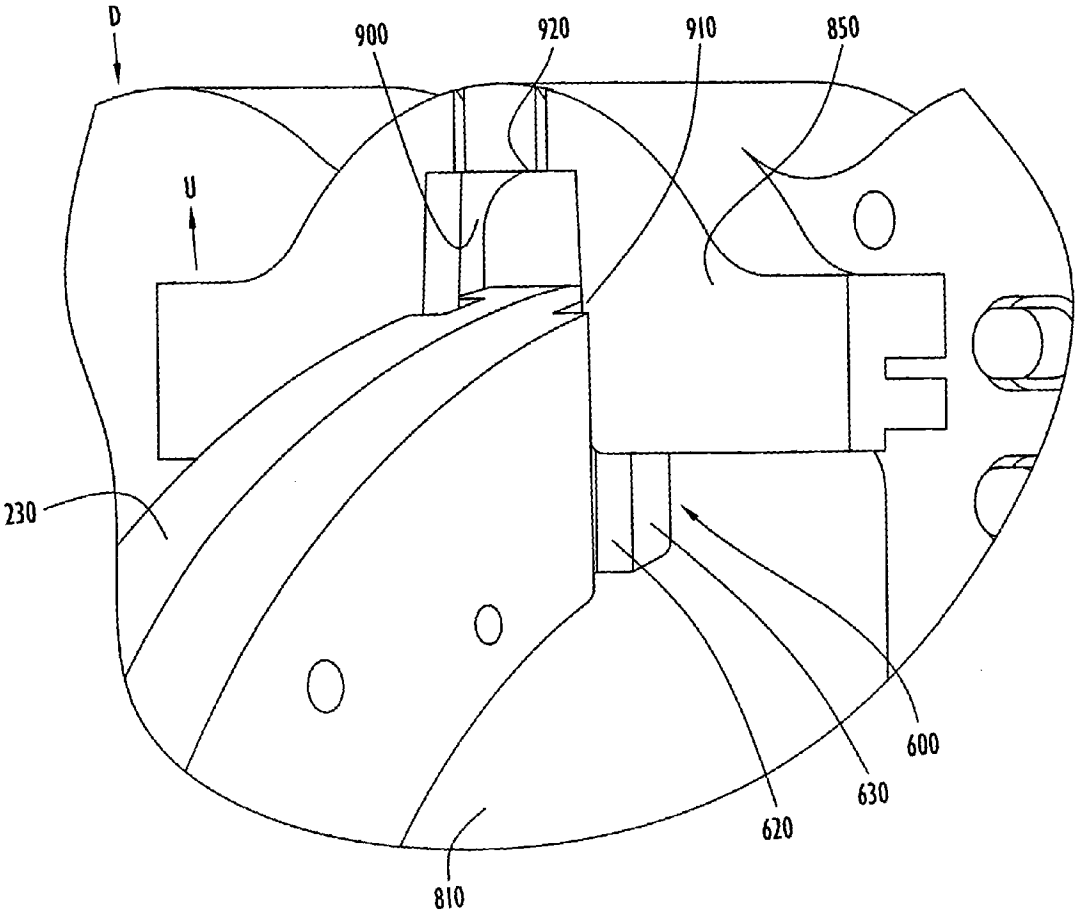
FIG. 9 illustrates a close-up view of one of the connecting members of the support arm as the infant entertainment device is mounted to the support arm in accordance with an embodiment of the present invention.

By way of further explanation, FIG. 9 illustrates a close-up view of the interaction between connecting member 600 of curved support arm 230 and attachment portion 850 on rear face 810 of entertainment device 220. FIG. 9 shows entertainment device 220 as it is being mounted onto connecting member 600 of curved support arm 230. The attachment portion 850 on the rear face 810 of entertainment device 220 is generally U-shaped with channels 900 and extensions 910 forming a mating recess to allow its removable attachment to connecting member 600 on curved support arm 230 or side wall connecting member 240 (as described in greater detail below). Thus, the U-shaped mating recess of the attachment portion 850 on the rear face 810 of entertainment device 220 allows entertainment device 220 to be selectively received on the side wall connecting member 240 as well as by similar connecting member 600 on curved support arm 230.

As entertainment device 220 is slid downward in direction D, tongue portions 630 on connecting member 600 are received in channels 900 of attachment portion 850. Additionally, extensions 910 of attachment portion 850 are received in lateral slots 620 on connecting member 600. This procedure securely mounts entertainment device 220 on the end of curved support arm 230. To remove the entertainment device 220 from the end of curved support arm 230, the reverse of this procedure is followed. That is, entertainment device 220 is slid upward in direction U to disengage it from connecting member 600 of curved support arm 230.

Figure 10:
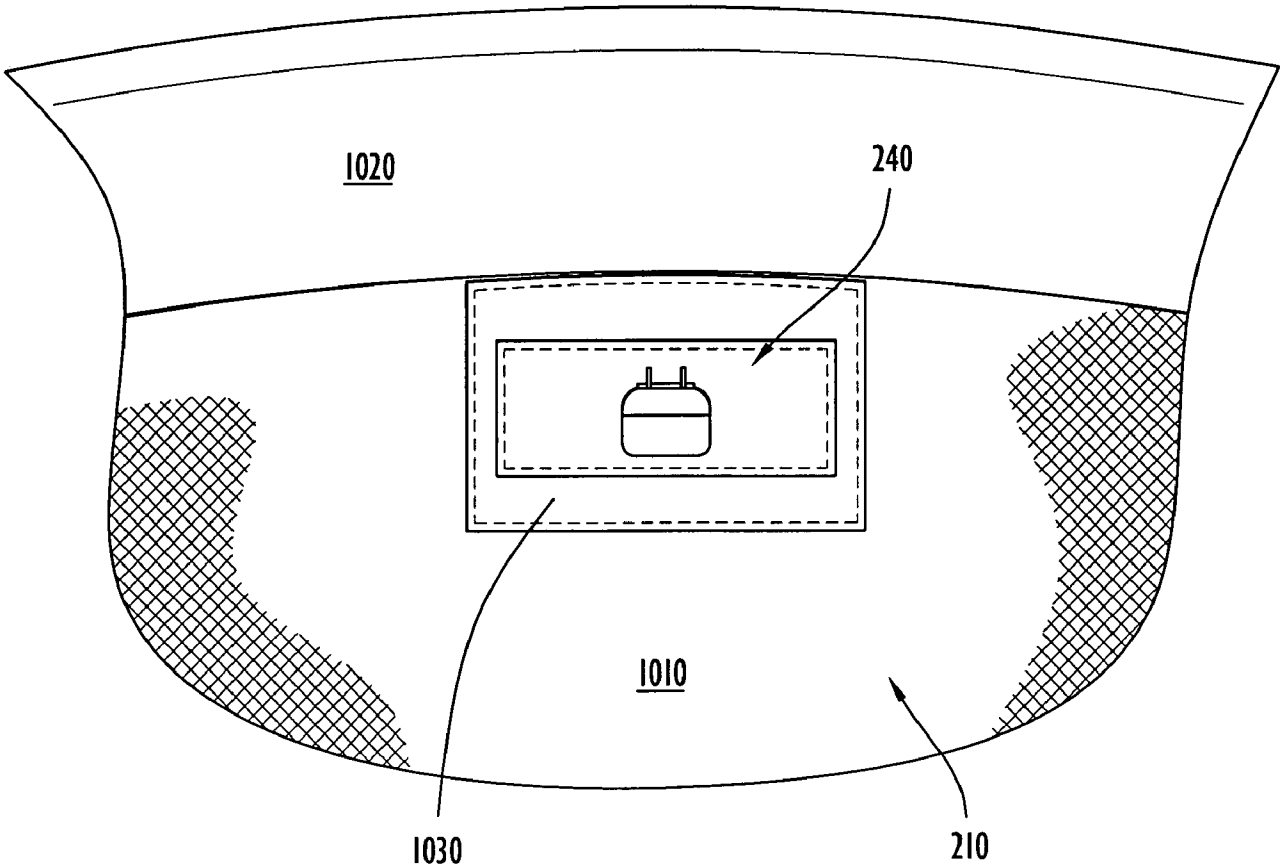
FIG. 10 illustrates a view of the inner surface of one of the side walls of the infant playard according to an embodiment of the present invention.

FIG. 10 illustrates the inner surface of one of the side walls 210 of the infant playard 100 according to an embodiment of the present invention. As shown, side wall connecting member 240 is attached to at least one of the side walls 210. Side walls 210 may include a mesh portion 1010 framed by a solid fabric portion 1020. The mesh portion 1010 of side wall 210 includes a side wall connecting member 240 mounted thereto. Side wall connecting member 240 is designed to selectively and removably receive entertainment device 220. Side wall connecting member 240 may be mounted to the mesh portion 1010 of side wall 210 by any known method (including adhesive, sewing, or the use of mounting fasteners). In the embodiment illustrated, side wall connecting member 240 is sewn to a pair of fabric panels 1030 (one on the outside of side wall 210 and one on the inside of side wall 210—thus the pair of fabric panels 1030 capture mesh portion 1010 therebetween and allow side wall connecting member 240 to be mounted to mesh portion 1010 of side wall 210).

Figure 11:
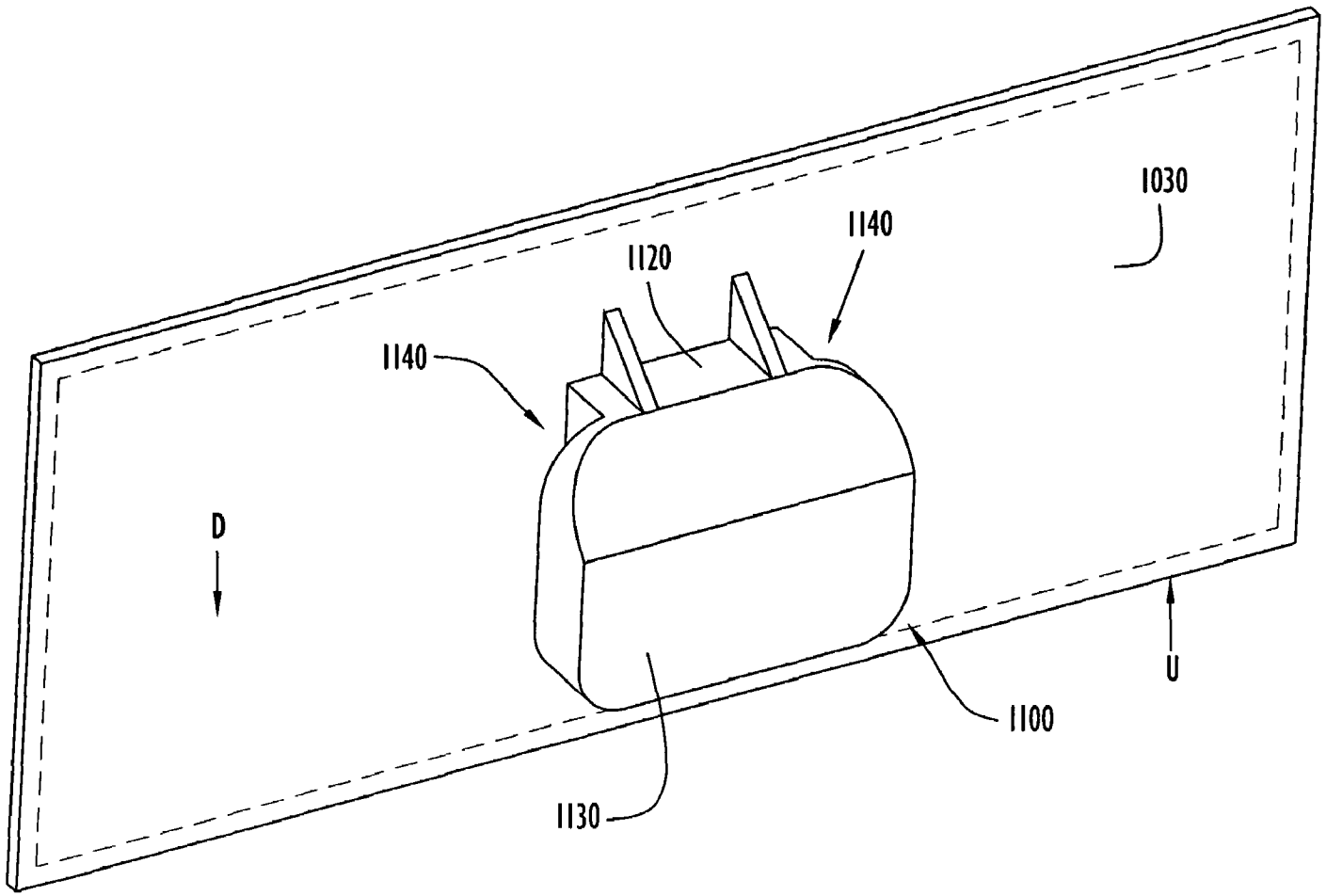
FIG. 11 illustrates an enlarged close-up view of the side wall connecting member on the inner surface of one of the side walls of the infant playard according to an embodiment of the present invention.

FIG. 11 illustrates a close-up view of side wall connecting member 240 according to an embodiment of the present invention. As illustrated, side wall connecting member 240 is mounted to mesh portion 1010 of side wall 210 via sewing to fabric panels 1030. Side wall connecting member 240 includes a raised boss 1100. Raised boss 1100 projects outwardly from the mesh portion 1010 of side wall 210 (toward the interior of playard 100). Raised boss 1100 includes a shaft portion 1120 and a terminating cap 1130. The perimeter of terminating cap 1130 is larger than shaft 1120, creating channels 1140. The geometry of raised boss 1100 is substantially similar to the geometry of connecting member 600 of curved support arm 230.

Entertainment device 220 may be selectively mounted onto the side wall connecting member 240 by sliding attachment portion 850 on rear face 810 of entertainment device 220 downward onto raised boss 1100 of side wall connecting member 240. The U-shaped attachment portion 850 on rear face 810 of the housing 260 of entertainment device 220 mates with shaft portion 1120 and terminating cap 1130 on side wall connecting member 240 to prevent the entertainment device 220 from being easily removed by a child from mesh portion 1010 of side wall 210.

As entertainment device 220 is slid downward in direction D (see FIG. 11), terminating cap 1130 on the raised boss 1100 of side wall connecting member 240 is received in channels 900 of the attachment portion 850 on rear face 810 of housing 260 of entertainment device 220. Additionally, extensions 910 on attachment portion 850 of housing 260 of entertainment device 220 are received into channels 1140 on raised boss 1100. This procedure securely mounts entertainment device 220 on raised boss 1100 of side wall connecting member 240. To remove entertainment device 220 from raised boss 1100 of side wall connecting member 240, the reverse of this procedure is followed. That is, entertainment device 220 is slid upward in direction U to disengage it from raised boss 1100 of side wall connecting member 240.

The tolerances between channels 1140 and extensions 910 provide sufficient frictional force to prevent entertainment device 220 from disengaging from side wall connecting member 240 without the application of sufficient additional force to overcome the frictional engagement. Thus, it would be extremely difficult for a young child to dislodge the entertainment device 220 from the side wall connecting member 240.

Figure 12:
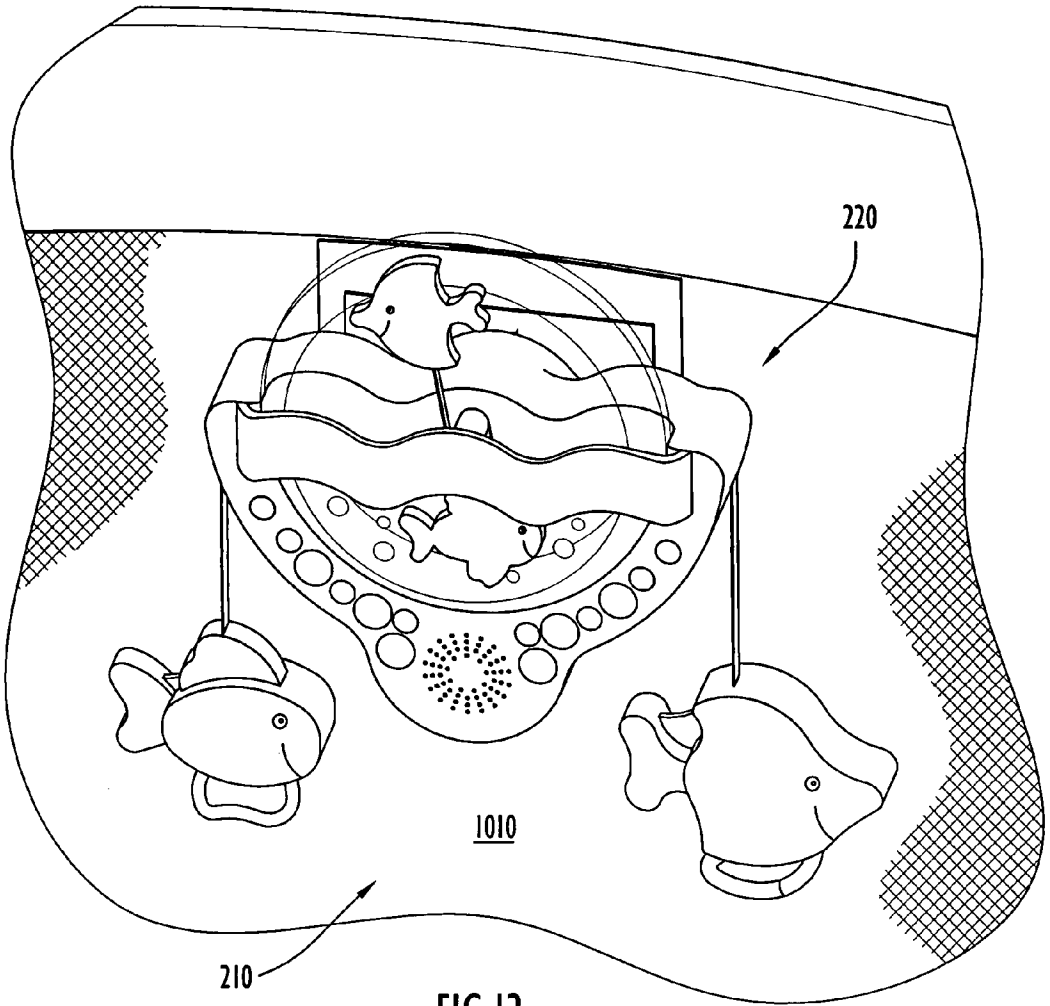
FIG. 12 illustrates a view of an entertainment device mounted to the side wall connecting member on one of the side walls of the infant playard in accordance with an embodiment of the present invention.

FIG. 12 illustrates a view of an entertainment device 220 mounted to side wall connecting member 240 on one of the side walls 210 of infant playard 100 in accordance with an embodiment of the present invention. As explained above, if an alternate configuration is desired, infant entertainment device 220 may be selectively removed from the side wall connecting member 240 and mounted to the curved support arm 230 of playard 100 as shown in FIGS. 1, 2, 3. Once attached to curved support arm 230, entertainment device 220 may be positioned in any corner of the playard 100 that includes a mounting plate 250. It is also understood that infant entertainment device 220 can be removably connected to curved support arm 230 or the side wall 210 by any known method without departing from the scope of the present invention.

Figure 13:
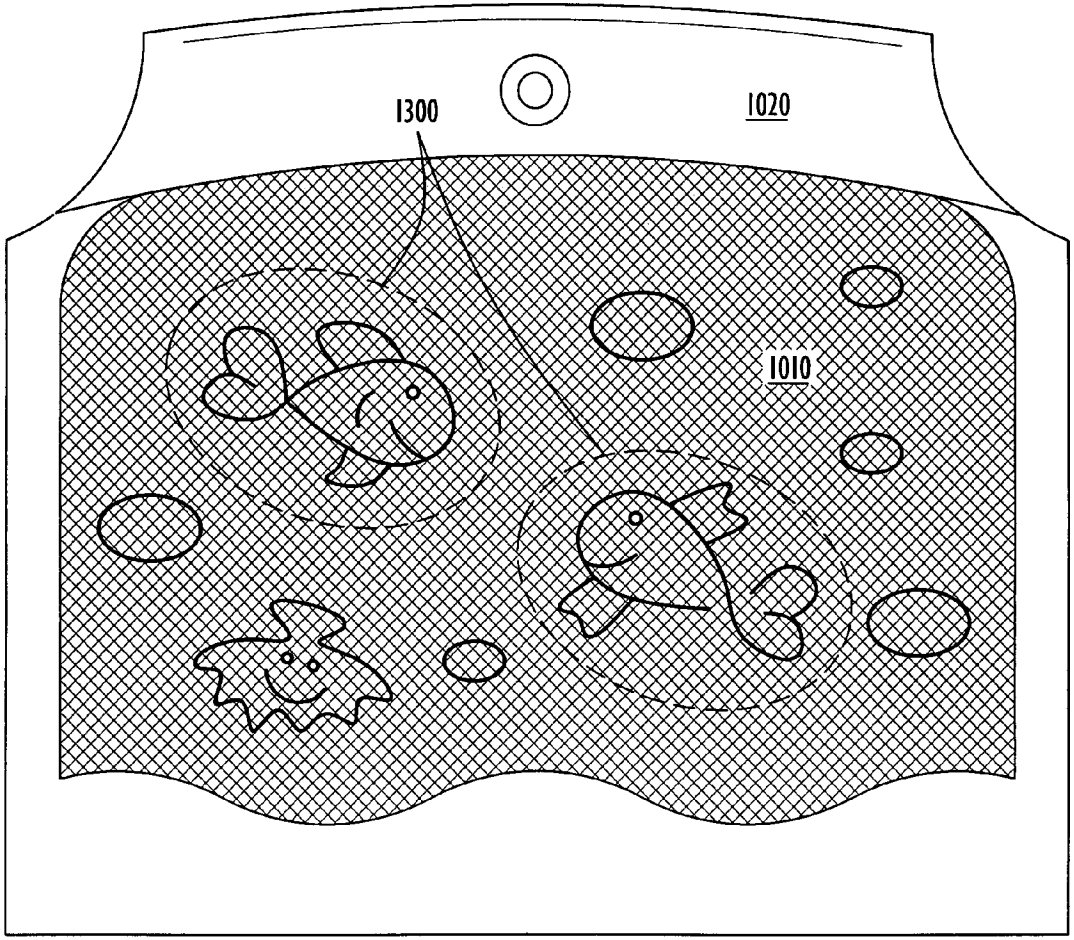
FIG. 13 illustrates a view of the indicia printed on the outer surface of one of the side walls of the infant playard according to an embodiment of the present invention.

FIG. 13 illustrates a view of indicia printed on the outer surface of one of the side walls 210 of the infant playard 100 according to an embodiment of the present invention. The playard 100 of the present invention includes four side walls 210 as shown in FIG. 1 (although any number of side walls may be utilized without departing from the scope of the present invention). As mentioned above, each of the side walls 210 may be formed from a breathable, semi-transparent mesh material 1010 bounded by solid fabric portion 1020. At least one of the side walls 210 may include visual indicia 1300 printed/painted thereon. In the embodiment of the present invention illustrated in FIG. 13, the visual indicia 1300 is a fish printed or painted on the mesh material 1010 of side wall 210. The visual indicia 1300 may be thematically related to the front display/indicia bearing portion 270 of the infant entertainment device 220. In the illustrated embodiments of the present invention, the theme of the visual indicia 1300 and the front display/indicia bearing portion 270 of the infant entertainment device 220 is an aquatic theme.

While the invention has been described in detail and with reference to specific embodiments thereof, it will be apparent to one skilled in the art that various changes and modifications can be made therein without departing from the spirit and scope thereof. For example, it is to be understood that terms such as "top", "bottom", "front", "rear", "side", "height", "length", "width", "upper", "lower", "interior", "exterior", "inner", "outer", and the like as may be used herein, merely describe points of reference and do not limit the present invention to any particular orientation or configuration. Additionally, the mounting method of the infant entertainment device described herein could also be applied to other infant receiving devices (cribs, bassinets, etc.). Thus, it is intended that the present invention covers the modifications and variations of this invention provided they come within the scope of the appended claims and their equivalents.

The invention claimed is:

1. An infant receiving device comprising:

an infant receiving portion, the infant receiving portion including a frame;

a first mounting member operable to removably mount an entertainment device at a first position on the infant receiving portion, the first mounting member being removably coupled to the frame; and a second mounting member operable to removably mount the entertainment device at a second, different position on the infant receiving portion, the second mounting member being fixedly coupled to the frame.

2. The infant receiving device of claim 1, wherein the infant receiving device is a playard.

3. The infant receiving device of claim 2, wherein the playard includes mesh side walls.

4. The infant receiving device of claim 3, wherein the mesh side walls include indicia printed thereon.

5. The infant receiving device of claim 4, wherein the entertainment device includes indicia reproduced on a portion thereof, and the indicia printed on the mesh side walls is thematically related to the indicia bearing portion of the entertainment device.

6. The infant receiving device of claim 1, wherein the infant receiving device is a crib.

7. The infant receiving device of claim 1, wherein the infant receiving device is a bassinet.

8. The infant receiving device of claim 1, wherein the first mounting member includes an arm received at the first position, the arm being operable to position the entertainment device above the infant receiving portion.

9. The infant receiving device of claim 3, wherein the second mounting member is attached to the mesh side walls.

10. A combination of an entertainment device and an infant receiving device, the combination comprising:

a housing; and means for alternately and removably mounting the housing to each of a side wall portion of the infant receiving device and a frame portion of the infant receiving device, the means for alternately and removably mounting including a first mounting member and a second mounting member, the first mounting member being removably coupled to the infant receiving device at a first location, and the second mounting member being fixedly coupled to the infant receiving device at a second location, the second location being different than the first location.

11. The combination of claim 10, wherein the infant receiving device is a playard.

12. The combination of claim 11, wherein the playard includes mesh side walls.

13. The combination of claim 12, wherein the mesh side walls include indicia printed thereon.

14. The combination of claim 13, wherein the entertainment device includes indicia reproduced on a portion thereof, and the indicia printed on the mesh side walls is thematically related to the indicia bearing portion of the entertainment device.

15. The combination of claim 10, wherein the infant receiving device is a crib.

16. The combination of claim 10, wherein the infant receiving device is a bassinet.

17. The combination of claim 10, wherein the first mounting member includes an arm attachable to the frame portion of the infant receiving device, the arm being operable to position the entertainment device above the infant receiving device.

18. The combination of claim 12, wherein the second mounting member is attached to at least one of the mesh side walls, the second mounting member being operable to mount the entertainment device to the at least one of the mesh side walls.

19. The combination of claim 12, wherein the first mounting member includes an arm attachable to the frame portion of the infant receiving device, the arm being operable to position the entertainment device above the infant receiving device; and the second mounting member is attached to at least one of the mesh side walls, the second mounting member being operable to mount the entertainment device to the at least one of the mesh side walls.

20. A combination of an entertainment device and an infant receiving device, the infant receiving device including side walls that define an infant receiving portion, the combination comprising:

a first mounting member for removably mounting the entertainment device at a first position on a frame of the infant receiving device, wherein the first mounting member comprises a support arm received on the frame of the infant receiving device;

a second mounting member for removably mounting the entertainment device at a second position on the infant receiving device, the second position being located on a side wall of the infant receiving portion; and indicia printed on at least one of the side walls of the infant receiving portion, wherein both the printed indicia and the entertainment device display features relating to a common theme.

21. The infant receiving device of claim 1, the first mounting member being coupled to the frame at a first location and configured to support the entertainment device in a first manner relative to the infant receiving portion, and the second mounting member being coupled to the frame at a second location, the second location being spaced apart from the first location, the second mounting member configured to support the entertainment device in a second manner relative to the infant receiving portion, the second manner being different than the first manner, the entertainment device being selectively mountable on the first mounting member at the first location and on the second mounting member at the second location.

22. The infant receiving device of claim 21, wherein the first location is above the infant receiving portion and the second location is within the infant receiving portion.

23. The infant receiving device of claim 21, wherein the frame includes mesh side walls, and the second mounting member is coupled to one of the mesh side walls.

24. The infant receiving device of claim 21, wherein the frame includes a side wall, the first mounting member includes a connecting member that is removably coupled to the frame, and the second mounting member includes its own connecting member that is fixedly coupled to the side wall.

25. The infant receiving device of claim 24, wherein the entertainment device includes a housing with an attachment portion, the attachment portion being configured to be coupled to the connecting members.

26. The infant receiving device of claim 21, wherein the frame includes a side wall, the first mounting member includes a support arm that is coupled to the frame, the second mounting member includes a connecting member that is coupled to the side wall, the entertainment device includes an attachment portion, the attachment portion receiving a portion of the support arm when the entertainment device is mounted at the first location, and the attachment portion receiving a portion of the connecting member when the entertainment device is mounted at the second location.

27. The infant receiving device of claim 26, wherein the support arm is removably coupled to the frame and the connecting member is fixedly coupled to the side wall.

28. The infant receiving device of claim 26, wherein the attachment portion defines a channel, and the channel is configured to receive a portion of the support arm and to receive a portion of the connecting member.

* * * * *